US005714974A

United States Patent [19]

Liu

[11] Patent Number: 5,714,974

[45] Date of Patent: Feb. 3, 1998

[54] DITHERING METHOD AND CIRCUIT USING DITHERING MATRIX ROTATION

[75] Inventor: Chih-Yuan Liu, HsinChu, Taiwan

[73] Assignee: Industrial Technology Research Laboratories, Taiwan

[21] Appl. No.: 233,029

[22] Filed: Apr. 25, 1994

Related U.S. Application Data

[63] Continuation of Ser. No. 837,476, Feb. 14, 1992, Pat. No. 5,389,948.

[51] Int. Cl.[6] ..... G09G 5/10

[52] U.S. Cl. ..... 345/149; 345/147

[58] Field of Search ..... 345/136–138, 345/147–150, 88, 89, 199; 395/158, 164; 382/270, 304; 358/457, 456

[56] References Cited

U.S. PATENT DOCUMENTS

| | | | |
|---|---|---|---|
| 4,377,821 | 3/1983 | Sautter et al. . | |
| 4,437,122 | 3/1984 | Walsh et al. | 358/456 |
| 4,706,077 | 11/1987 | Roberts et al. | 345/149 |
| 4,730,185 | 3/1988 | Springer et al. . | |
| 4,758,893 | 7/1988 | Lippel | 358/37 |
| 4,780,711 | 10/1988 | Doumas | 345/137 |
| 4,821,115 | 4/1989 | Matsushima et al. . | |
| 4,914,524 | 4/1990 | Kimura . | |
| 4,930,022 | 5/1990 | Kubota . | |
| 4,956,638 | 9/1990 | Larky et al. . | |
| 5,014,124 | 5/1991 | Fujisawa | 358/457 |
| 5,062,001 | 10/1991 | Furwell et al. | 340/793 |
| 5,068,649 | 11/1991 | Garrett | 345/89 |
| 5,111,194 | 5/1992 | Oneda | 340/793 |
| 5,122,783 | 6/1992 | Bassetti, Jr. | 340/793 |
| 5,148,273 | 9/1992 | Lippel | 358/138 |
| 5,150,428 | 9/1992 | Leone et al. | 382/270 |
| 5,237,626 | 8/1993 | Forslund et al. | 382/304 |
| 5,266,940 | 11/1993 | Shiraishi | 345/149 |
| 5,295,245 | 3/1994 | Alcorn et al. | 395/164 |
| 5,298,915 | 3/1994 | Bassetti, Jr. | 345/149 |
| 5,301,269 | 4/1994 | Alcorn et al. | 395/158 |

OTHER PUBLICATIONS

Fundamentals of Interactive Computer Graphics, by Foley and Van Damm, Addison–Wesley Publishing Co., Ltd. 1982, pp. 600–602.

*Primary Examiner*—Steven Saras

*Attorney, Agent, or Firm*—Meltzer, Lippe, Goldstein, et al.

[57] ABSTRACT

A display device with improved color and grey scale capability employs an improved time dependent dithering technique. In the display device, each pixel is controlled so as to be illuminated for only a certain number of times during a display time period, the number of illuminations during the display period being dependent on the color or grey scale value of a corresponding pixel in an original image and a dither matrix element. After each frame in the fixed time period, the dither matrix elements are circulated to a new position, thereby introducing a time factor into the dithering technique.

9 Claims, 12 Drawing Sheets

FIG. 1A
X BLACK ● WHITE
| Y \ X | 0 | 1 | 2 | 3 | 4 | 5 | 6 | 7 ··· |
|---|---|---|---|---|---|---|---|---|
| 0 | 0 | 8 | 2 | 10 | 0 | 8 | 2 | 10 |
| 1 | 12 | 4 | 14 | 6 | 12 | 4 | 14 | 6 |
| 2 | 3 | 11 | 1 | 9 | 3 | 11 | 1 | 9 |
| 3 | 15 | 7 | 13 | 5 | 15 | 7 | 13 | 5 ··· |
| 4 | 0 | 8 | 2 | 10 | 0 | 8 | 2 | 10 |
| 5 | 12 | 4 | 14 | 6 | 12 | 4 | 14 | 6 |
| 6 | 3 | 11 | 1 | 9 | 3 | 11 | 1 | 9 |
| 7 | 15 | 7 | 13 | 5 | 15 | 7 | 13 | 5 |
FIG. 1B
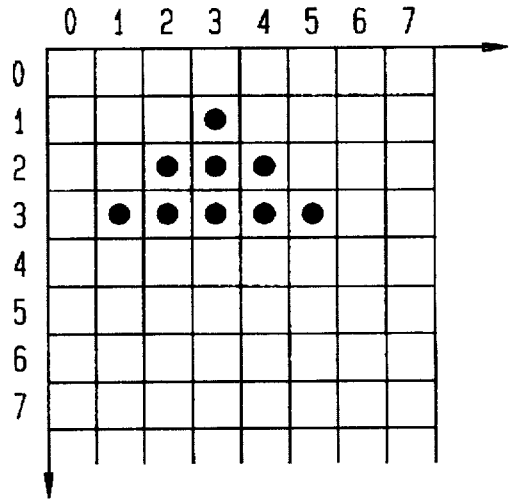
FIG. 1C
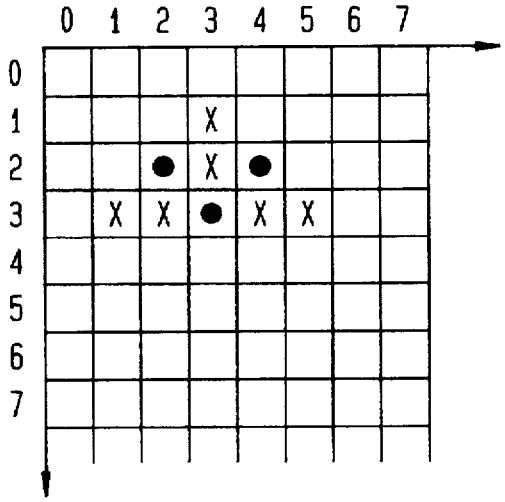
FIG. 1D
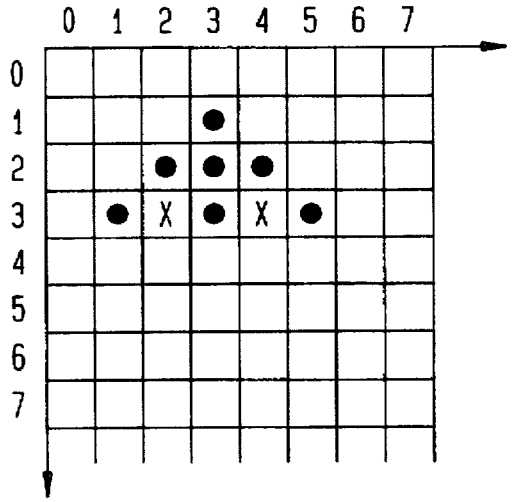

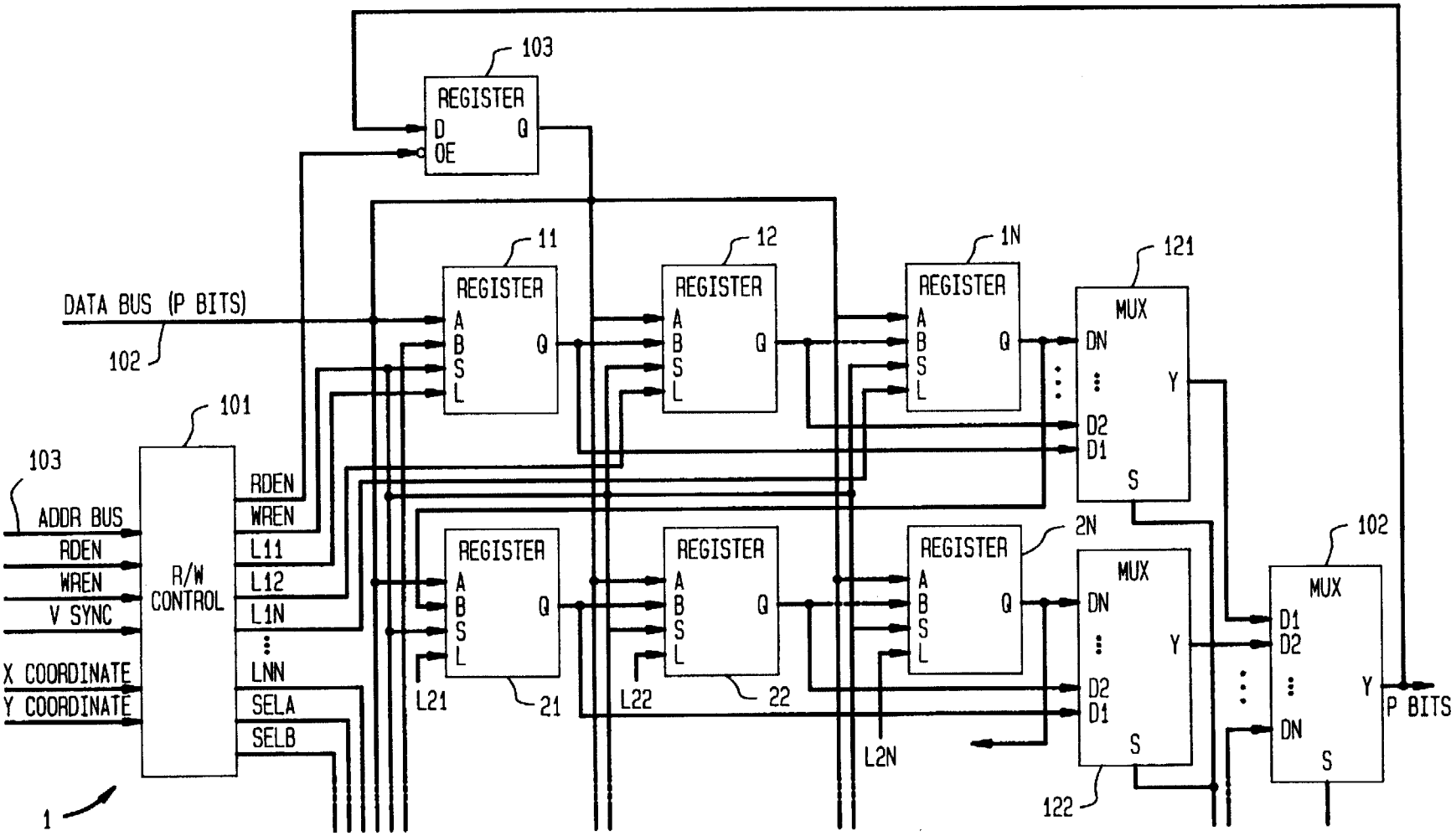
FIG. 2A1

FIG. 2A2

| FIG. 2A1 | FIG. 2A2 |
|---|---|

MUX LOGIC

| S | Y |
|---|---|
| 0 | A |
| 1 | B |

LATCH LOGIC

| L | Q |
|---|---|
| ↑ | D |
| 1 | Q |
| 0 | Q |
| ↓ | Q |

T=0

| Y \ X | 0 | 1 | 2 | 3 | 4 | 5 | 6 | 7 |
|---|---|---|---|---|---|---|---|---|
| 0 | 0 | 8 | 2 | 10 | 0 | 8 | 2 | 10 |
| 1 | 12 | 4 | 14 | 6 | 12 | 4 | 14 | 6 |
| 2 | 3 | 11 | 1 | 9 | 3 | 11 | 1 | 9 |
| 3 | 15 | 7 | 13 | 5 | 15 | 7 | 13 | 5 |
| 4 | 0 | 8 | 2 | 10 | 0 | 8 | 2 | 10 |
| 5 | 12 | 4 | 14 | 6 | 12 | 4 | 14 | 6 |
| 6 | 3 | 11 | 1 | 9 | 3 | 11 | 1 | 9 |
| 7 | 15 | 7 | 13 | 5 | 15 | 7 | 13 | 5 |

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | 0 | 1 | 0 | | |
| 4 | | 1 | 1 | 1 | | |
| 5 | | 0 | 1 | 0 | | |
| 6 | | | | | | |
| 7 | | | | | | |

T=1

| Y \ X | 0 | 1 | 2 | 3 | 4 | 5 | 6 | 7 |
|---|---|---|---|---|---|---|---|---|
| 0 | 5 | 0 | 8 | 2 | 5 | 0 | 8 | 2 |
| 1 | 10 | 12 | 4 | 14 | 10 | 12 | 4 | 14 |
| 2 | 6 | 3 | 11 | 1 | 6 | 3 | 11 | 1 |
| 3 | 9 | 15 | 7 | 13 | 9 | 15 | 7 | 13 |
| 4 | 5 | 0 | 8 | 2 | 5 | 0 | 8 | 2 |
| 5 | 10 | 12 | 4 | 14 | 10 | 12 | 4 | 14 |
| 6 | 6 | 3 | 11 | 1 | 6 | 3 | 11 | 1 |
| 7 | 9 | 15 | 7 | 13 | 9 | 15 | 7 | 13 |

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | 1 | 0 | 1 | | |
| 4 | | 1 | 1 | 1 | | |
| 5 | | 1 | 0 | 1 | | |
| 6 | | | | | | |
| 7 | | | | | | |

FIG. 3C

T=2

| Y \ X | 0 | 1 | 2 | 3 | 4 | 5 | 6 | 7 |
|---|---|---|---|---|---|---|---|---|
| 0 | 13 | 5 | 0 | 8 | 13 | 5 | 0 | 8 |
| 1 | 2 | 10 | 12 | 4 | 2 | 10 | 12 | 4 |
| 2 | 14 | 6 | 3 | 11 | 14 | 6 | 3 | 11 |
| 3 | 1 | 9 | 15 | 7 | 1 | 9 | 15 | 7 |
| 4 | 13 | 5 | 0 | 8 | 13 | 5 | 0 | 8 |
| 5 | 2 | 10 | 12 | 4 | 2 | 10 | 12 | 4 |
| 6 | 14 | 6 | 3 | 11 | 14 | 6 | 3 | 11 |
| 7 | 1 | 9 | 15 | 7 | 1 | 9 | 15 | 7 |

FIG. 4C

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | 0 | 1 | 1 | | | |
| 4 | 1 | 1 | 0 | | | |
| 5 | 0 | 1 | 1 | | | |
| 6 | | | | | | |
| 7 | | | | | | |

FIG. 3D

T=3

| Y \ X | 0 | 1 | 2 | 3 | 4 | 5 | 6 | 7 |
|---|---|---|---|---|---|---|---|---|
| 0 | 7 | 13 | 5 | 0 | 7 | 13 | 5 | 0 |
| 1 | 8 | 2 | 10 | 12 | 8 | 2 | 10 | 12 |
| 2 | 4 | 14 | 6 | 3 | 4 | 14 | 6 | 3 |
| 3 | 11 | 1 | 9 | 15 | 11 | 1 | 9 | 15 |
| 4 | 7 | 13 | 5 | 0 | 7 | 13 | 5 | 0 |
| 5 | 8 | 2 | 10 | 12 | 8 | 2 | 10 | 12 |
| 6 | 4 | 14 | 6 | 3 | 4 | 14 | 6 | 3 |
| 7 | 11 | 1 | 9 | 15 | 11 | 1 | 9 | 15 |

FIG. 4D

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | 1 | 0 | 1 | | | |
| 4 | 1 | 1 | 1 | | | |
| 5 | 1 | 0 | 1 | | | |
| 6 | | | | | | |
| 7 | | | | | | |

FIG. 3E

T=4

| Y \ X | 0 | 1 | 2 | 3 | 4 | 5 | 6 | 7 |
|---|---|---|---|---|---|---|---|---|
| 0 | 15 | 7 | 13 | 5 | 15 | 7 | 13 | 5 |
| 1 | 0 | 8 | 2 | 10 | 0 | 8 | 2 | 10 |
| 2 | 12 | 4 | 14 | 6 | 12 | 4 | 14 | 6 |
| 3 | 3 | 11 | 1 | 9 | 3 | 11 | 1 | 9 |
| 4 | 15 | 7 | 13 | 5 | 15 | 7 | 13 | 5 |
| 5 | 0 | 8 | 2 | 10 | 0 | 8 | 2 | 10 |
| 6 | 12 | 4 | 14 | 6 | 12 | 4 | 14 | 6 |
| 7 | 3 | 11 | 1 | 9 | 3 | 11 | 1 | 9 |

FIG. 4E

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | 1 | 1 | 1 | | | |
| 4 | 0 | 1 | 0 | | | |
| 5 | 1 | 1 | 1 | | | |
| 6 | | | | | | |
| 7 | | | | | | |

FIG. 3F

T=5

| Y \ X | 0 | 1 | 2 | 3 | 4 | 5 | 6 | 7 |
|---|---|---|---|---|---|---|---|---|
| 0 | 9 | 15 | 7 | 13 | 9 | 15 | 7 | 13 |
| 1 | 5 | 0 | 8 | 2 | 5 | 0 | 8 | 2 |
| 2 | 10 | 12 | 4 | 14 | 10 | 12 | 4 | 14 |
| 3 | 6 | 3 | 11 | 1 | 6 | 3 | 11 | 1 |
| 4 | 9 | 15 | 7 | 13 | 9 | 15 | 7 | 13 |
| 5 | 5 | 0 | 8 | 2 | 5 | 0 | 8 | 2 |
| 6 | 10 | 12 | 4 | 14 | 10 | 12 | 4 | 14 |
| 7 | 6 | 3 | 11 | 1 | 6 | 3 | 11 | 1 |

FIG. 4F

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | | 1 | 1 | 1 | |
| 4 | | | 1 | 0 | 1 | |
| 5 | | | 1 | 1 | 1 | |
| 6 | | | | | | |
| 7 | | | | | | |

FIG. 3G

T=6

| Y \ X | 0 | 1 | 2 | 3 | 4 | 5 | 6 | 7 |
|---|---|---|---|---|---|---|---|---|
| 0 | 1 | 9 | 15 | 7 | 1 | 9 | 15 | 7 |
| 1 | 13 | 5 | 0 | 8 | 13 | 5 | 0 | 8 |
| 2 | 2 | 10 | 12 | 4 | 2 | 10 | 12 | 4 |
| 3 | 14 | 6 | 3 | 11 | 14 | 6 | 3 | 11 |
| 4 | 1 | 9 | 15 | 7 | 1 | 9 | 15 | 7 |
| 5 | 13 | 5 | 0 | 8 | 13 | 5 | 0 | 8 |
| 6 | 2 | 10 | 12 | 4 | 2 | 10 | 12 | 4 |
| 7 | 14 | 6 | 3 | 11 | 14 | 6 | 3 | 11 |

FIG. 4G

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | | 1 | 1 | 0 | |
| 4 | | | 0 | 1 | 1 | |
| 5 | | | 1 | 1 | 0 | |
| 6 | | | | | | |
| 7 | | | | | | |

FIG. 3H

T=7

| Y \ X | 0 | 1 | 2 | 3 | 4 | 5 | 6 | 7 |
|---|---|---|---|---|---|---|---|---|
| 0 | 11 | 1 | 9 | 15 | 11 | 1 | 9 | 15 |
| 1 | 7 | 13 | 5 | 0 | 7 | 13 | 5 | 0 |
| 2 | 8 | 2 | 10 | 12 | 8 | 2 | 10 | 12 |
| 3 | 4 | 14 | 6 | 3 | 4 | 14 | 6 | 3 |
| 4 | 11 | 1 | 9 | 15 | 11 | 1 | 9 | 5 |
| 5 | 7 | 13 | 5 | 0 | 7 | 13 | 5 | 0 |
| 6 | 8 | 2 | 10 | 12 | 8 | 2 | 10 | 12 |
| 7 | 4 | 14 | 6 | 3 | 4 | 14 | 6 | 3 |

FIG. 4H

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | | 1 | 1 | 1 | |
| 4 | | | 1 | 0 | 1 | |
| 5 | | | 1 | 1 | 1 | |
| 6 | | | | | | |
| 7 | | | | | | |

FIG. 3I

T=8

| Y \ X | 0 | 1 | 2 | 3 | 4 | 5 | 6 | 7 |
|---|---|---|---|---|---|---|---|---|
| 0 | 3 | 11 | 1 | 9 | 3 | 11 | 1 | 9 |
| 1 | 15 | 7 | 13 | 5 | 15 | 7 | 13 | 5 |
| 2 | 0 | 8 | 2 | 10 | 0 | 8 | 2 | 10 |
| 3 | 12 | 4 | 14 | 6 | 12 | 4 | 14 | 6 |
| 4 | 3 | 11 | 1 | 9 | 3 | 11 | 1 | 9 |
| 5 | 15 | 7 | 13 | 5 | 15 | 7 | 13 | 5 |
| 6 | 0 | 8 | 2 | 10 | 0 | 8 | 2 | 10 |
| 7 | 12 | 4 | 14 | 6 | 12 | 4 | 14 | 6 |

FIG. 4I

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | 0 | 1 | 0 | | |
| 4 | | 1 | 1 | 1 | | |
| 5 | | 0 | 1 | 0 | | |
| 6 | | | | | | |
| 7 | | | | | | |

FIG. 3J

T=9

| Y \ X | 0 | 1 | 2 | 3 | 4 | 5 | 6 | 7 |
|---|---|---|---|---|---|---|---|---|
| 0 | 6 | 3 | 11 | 1 | 6 | 3 | 11 | 1 |
| 1 | 9 | 15 | 7 | 13 | 9 | 15 | 7 | 13 |
| 2 | 5 | 0 | 8 | 2 | 5 | 0 | 8 | 2 |
| 3 | 10 | 12 | 4 | 14 | 10 | 12 | 4 | 14 |
| 4 | 6 | 3 | 11 | 1 | 6 | 3 | 11 | 1 |
| 5 | 9 | 15 | 7 | 13 | 9 | 15 | 7 | 13 |
| 6 | 5 | 0 | 8 | 2 | 5 | 0 | 8 | 2 |
| 7 | 10 | 12 | 4 | 14 | 10 | 12 | 4 | 14 |

FIG. 4J

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | 1 | 0 | 1 | | |
| 4 | | 1 | 1 | 1 | | |
| 5 | | 1 | 0 | 1 | | |
| 6 | | | | | | |
| 7 | | | | | | |

FIG. 3K

T=10

| Y \ X | 0 | 1 | 2 | 3 | 4 | 5 | 6 | 7 |
|---|---|---|---|---|---|---|---|---|
| 0 | 14 | 6 | 3 | 11 | 14 | 6 | 3 | 11 |
| 1 | 1 | 9 | 15 | 7 | 1 | 9 | 15 | 7 |
| 2 | 13 | 5 | 0 | 8 | 13 | 5 | 0 | 8 |
| 3 | 2 | 10 | 12 | 4 | 2 | 10 | 12 | 4 |
| 4 | 14 | 6 | 3 | 11 | 14 | 6 | 3 | 11 |
| 5 | 1 | 9 | 15 | 7 | 1 | 9 | 15 | 7 |
| 6 | 13 | 5 | 0 | 8 | 13 | 5 | 0 | 8 |
| 7 | 2 | 10 | 12 | 4 | 2 | 10 | 12 | 4 |

FIG. 4K

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | 0 | 1 | 1 | | |
| 4 | | 1 | 1 | 0 | | |
| 5 | | 0 | 1 | 1 | | |
| 6 | | | | | | |
| 7 | | | | | | |

FIG. 3L

T=11

| Y \ X | 0 | 1 | 2 | 3 | 4 | 5 | 6 | 7 |
|---|---|---|---|---|---|---|---|---|
| 0 | 4 | 14 | 6 | 3 | 4 | 14 | 6 | 3 |
| 1 | 11 | 1 | 9 | 15 | 11 | 1 | 9 | 15 |
| 2 | 7 | 13 | 5 | 0 | 7 | 13 | 5 | 0 |
| 3 | 8 | 2 | 10 | 12 | 8 | 2 | 10 | 12 |
| 4 | 4 | 14 | 6 | 3 | 4 | 14 | 6 | 3 |
| 5 | 11 | 1 | 9 | 15 | 11 | 1 | 9 | 15 |
| 6 | 7 | 13 | 5 | 0 | 7 | 13 | 5 | 0 |
| 7 | 8 | 2 | 10 | 12 | 8 | 2 | 10 | 12 |

FIG. 4L

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | | 1 | 0 | 1 | |
| 4 | | | 1 | 1 | 1 | |
| 5 | | | 1 | 0 | 1 | |
| 6 | | | | | | |
| 7 | | | | | | |

FIG. 3M

T=12

| Y \ X | 0 | 1 | 2 | 3 | 4 | 5 | 6 | 7 |
|---|---|---|---|---|---|---|---|---|
| 0 | 12 | 4 | 14 | 6 | 12 | 4 | 14 | 6 |
| 1 | 3 | 11 | 1 | 9 | 3 | 11 | 1 | 9 |
| 2 | 15 | 7 | 13 | 5 | 15 | 7 | 13 | 5 |
| 3 | 0 | 8 | 2 | 10 | 0 | 8 | 2 | 10 |
| 4 | 12 | 4 | 14 | 6 | 12 | 4 | 14 | 6 |
| 5 | 3 | 11 | 1 | 9 | 3 | 11 | 1 | 9 |
| 6 | 15 | 7 | 13 | 5 | 15 | 7 | 13 | 5 |
| 7 | 0 | 8 | 2 | 10 | 0 | 8 | 2 | 10 |

FIG. 4M

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | | 1 | 1 | 1 | |
| 4 | | | 0 | 1 | 0 | |
| 5 | | | 1 | 1 | 1 | |
| 6 | | | | | | |
| 7 | | | | | | |

FIG. 3N

T=13

| Y \ X | 0 | 1 | 2 | 3 | 4 | 5 | 6 | 7 |
|---|---|---|---|---|---|---|---|---|
| 0 | 10 | 12 | 4 | 14 | 10 | 12 | 4 | 14 |
| 1 | 6 | 3 | 11 | 1 | 6 | 3 | 11 | 1 |
| 2 | 9 | 15 | 7 | 13 | 9 | 15 | 7 | 13 |
| 3 | 5 | 0 | 8 | 2 | 5 | 0 | 8 | 2 |
| 4 | 10 | 12 | 4 | 14 | 10 | 12 | 4 | 14 |
| 5 | 6 | 3 | 11 | 1 | 6 | 3 | 11 | 1 |
| 6 | 9 | 15 | 7 | 13 | 9 | 15 | 7 | 13 |
| 7 | 5 | 0 | 8 | 2 | 5 | 0 | 8 | 2 |

FIG. 4N

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | | 1 | 1 | 1 | |
| 4 | | | 1 | 0 | 1 | |
| 5 | | | 1 | 1 | 1 | |
| 6 | | | | | | |
| 7 | | | | | | |

FIG. 30

T=14

| Y \ X | 0 | 1 | 2 | 3 | 4 | 5 | 6 | 7 |
|---|---|---|---|---|---|---|---|---|
| 0 | 2 | 10 | 12 | 4 | 2 | 10 | 12 | 4 |
| 1 | 14 | 6 | 3 | 11 | 14 | 6 | 3 | 11 |
| 2 | 1 | 9 | 15 | 7 | 1 | 9 | 15 | 7 |
| 3 | 13 | 5 | 0 | 8 | 13 | 5 | 0 | 8 |
| 4 | 2 | 10 | 12 | 4 | 2 | 10 | 12 | 4 |
| 5 | 14 | 6 | 3 | 11 | 14 | 6 | 3 | 11 |
| 6 | 1 | 9 | 15 | 7 | 1 | 9 | 15 | 7 |
| 7 | 13 | 5 | 0 | 8 | 13 | 5 | 0 | 8 |

FIG. 40

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | | 1 | 1 | 0 | |
| 4 | | | 0 | 1 | 1 | |
| 5 | | | 1 | 1 | 0 | |
| 6 | | | | | | |
| 7 | | | | | | |

FIG. 3P

T=15

| Y \ X | 0 | 1 | 2 | 3 | 4 | 5 | 6 | 7 |
|---|---|---|---|---|---|---|---|---|
| 0 | 8 | 2 | 10 | 12 | 8 | 2 | 10 | 12 |
| 1 | 4 | 14 | 6 | 3 | 4 | 14 | 6 | 3 |
| 2 | 11 | 1 | 9 | 15 | 11 | 1 | 9 | 15 |
| 3 | 7 | 13 | 5 | 0 | 7 | 13 | 5 | 0 |
| 4 | 8 | 2 | 10 | 12 | 8 | 2 | 10 | 12 |
| 5 | 4 | 14 | 6 | 3 | 4 | 14 | 6 | 3 |
| 6 | 11 | 1 | 9 | 15 | 11 | 1 | 9 | 15 |
| 7 | 7 | 13 | 5 | 0 | 7 | 13 | 5 | 0 |

FIG. 4P

| Y \ X | 0 | 1 | 2 | 3 | 4 | 5 |
|---|---|---|---|---|---|---|
| 0 | | | | | | |
| 1 | | | | | | |
| 2 | | | | | | |
| 3 | | | 1 | 1 | 1 | |
| 4 | | | 1 | 0 | 1 | |
| 5 | | | 1 | 1 | 1 | |
| 6 | | | | | | |
| 7 | | | | | | |

DITHERING METHOD AND CIRCUIT USING DITHERING MATRIX ROTATION

This is a continuation of application Ser. No. 07/837,476, filed Feb. 14, 1992 now U.S. Pat. No. 5,389,948.

RELATED CASE

An application entitled "Dithering Circuit and Method" has been filed on even date herewith for the inventor hereof and is assigned to the assignee hereof. The related application bears Ser. No. 07/837,476 now U.S. Pat. No. 5,389,948.

FIELD OF THE INVENTION

The present invention relates to a method and an apparatus that can be used to improve the color and the grey scale capability of a display device capable of displaying a limited number of colors or grey scales. More particularly, the present invention relates to an improved dithering technique which incorporates a time factor for enhancing the color and grey scale capability of a display device.

BACKGROUND OF THE INVENTION

The conventional technique of dithering is utilized to display many colors and grey scales on a display device having relatively few colors and grey scales without having to change the resolution of the display device. For example, through the use of the dithering technique, it is possible to display a 16-color image on a display device having only an 8-color palette. Similarly, by using dithering, it is possible to display an image formed from 16 grey scales on a binary display device in which each pixel can only be turned on or off. The underlying principle of dithering is to rely on a particular spatial distribution of illuminated pixels and non-illuminated pixels to reproduce the color and/or brightness of an original image on the display. When the original image is that of a natural scene such as scenery or portraits, the image displayed by this technique is very close to the original. However, when the original is a computer-generated image, the quality of the displayed image is very much distorted. Conventional dithering is explained in detail in a book entitled, "Fundamentals of Interactive Computer Graphics," by Foley and Van Damm (Addison-Wesley Publishing Co., Ltd., 1982), at pp. 600–602. A 4×4 dither matrix is given therein as follows:

$$D^{(4)}(i,j) = \begin{matrix} D_{00} & D_{10} & D_{20} & D_{30} \\ D_{01} & D_{11} & D_{21} & D_{31} \\ D_{02} & D_{12} & D_{22} & D_{32} \\ D_{03} & D_{13} & D_{23} & D_{33} \end{matrix} = \begin{matrix} 0 & 8 & 2 & 10 \\ 12 & 4 & 14 & 6 \\ 3 & 11 & 1 & 9 \\ 15 & 7 & 13 & 5 \end{matrix}$$

The dither matrix $D^{(4)}$ maps into X-Y space as shown in FIG. 1(*a*). Specifically, D(X,Y)=D(i,j) for i=X mod 4 and j=Y mod 4. Conversion between a grey scale representation and a binary representation using conventional dithering may be illustrated by applying the dither matrix $D^{(4)}$ to the triangle shown in FIG. 1(*b*). For each point (X,Y) of the triangle, the following equation is applied:

$$\text{if } P_{old}(x,y) \geqq D(x,y), \quad (1)$$

$$\text{then } P_{new}=1,$$

$$\text{else } P_{new}=0,$$

where $P_{old}$ is the value of the pixel at location X,Y in the grey scale representation and $P_{new}$ is the value of the same pixel in the binary representation.

When the grey scale of the triangle in FIG. 1(*b*) is 5 (assuming a total of 16 grey scales with grey scale 0=black and grey scale 15=white), the results of applying this equation to the triangle are given below and are illustrated in FIG. 1(*c*).

| | |
|---|---|
| $P_{old}(3, 1) = 5 < D(3, 1) = 10$ | $P_{new}(3, 1) = 0$ |
| $P_{old}(2, 2) = 5 > D(2, 2) = 1$ | $P_{new}(2, 2) = 1$ |
| $P_{old}(3, 2) = 5 < D(3, 2) = 9$ | $P_{new}(3, 2) = 0$ |
| $P_{old}(4, 2) = 5 > D(4, 2) = 3$ | $P_{new}(4, 2) = 1$ |
| $P_{old}(1, 3) = 5 < D(1, 3) = 7$ | $P_{new}(1, 3) = 0$ |
| $P_{old}(2, 3) = 5 < D(2, 3) = 13$ | $P_{new}(2, 3) = 0$ |
| $P_{old}(3, 3) = 5 = D(3, 3) = 5$ | $P_{new}(3, 3) = 1$ |
| $P_{old}(4, 3) = 5 < D(4, 3) = 15$ | $P_{new}(4, 3) = 0$ |
| $P_{old}(5, 3) = 5 < D(5, 3) = 7$ | $P_{new}(5, 3) = 0$ |

When the grey scale of the triangle in FIG. 1(*b*) is 11, the results are given below and are illustrated in FIG. 1(*d*).

| | |
|---|---|
| $P_{old}(3, 1) = 11 > D(3, 1) = 10$ | $P_{new}(3, 1) = 1$ |
| $P_{old}(2, 2) = 11 > D(2, 2) = 1$ | $P_{new}(2, 2) = 1$ |
| $P_{old}(3, 2) = 11 > D(3, 2) = 9$ | $P_{new}(3, 2) = 1$ |
| $P_{old}(4, 2) = 11 > D(4, 2) = 3$ | $P_{new}(4, 2) = 1$ |
| $P_{old}(1, 3) = 11 > D(1, 3) = 7$ | $P_{new}(1, 3) = 0$ |
| $P_{old}(2, 3) = 11 < D(2, 3) = 13$ | $P_{new}(2, 3) = 0$ |
| $P_{old}(3, 3) = 11 > D(3, 3) = 5$ | $P_{new}(3, 3) = 1$ |
| $P_{old}(4, 3) = 11 < D(4, 3) = 15$ | $P_{new}(4, 3) = 0$ |
| $P_{old}(5, 3) = 11 > D(5, 3) = 7$ | $P_{new}(5, 3) = 1$ |

As shown by this example, the conventional technique of dithering does not faithfully represent the original image. In both examples, the distribution of illuminated pixels on the binary display is not a faithful reproduction of the original grey scale image.

Other prior art dithering systems also do not perform entirely satisfactorily in representing an original image (see, e.g., Kubota, U.S. Pat. No. 4,930,022); Kimura, U.S. Pat. No. 4,914,524; Springer et al, U.S. Pat. No. 4,730,185; Larky et al, U.S. Pat. No. 4,956,638; Sautter et al, U.S. Pat. No. 4,377,821).

To overcome this disadvantage, the present invention has as its object to provide a method and an apparatus for a display device having relatively few colors or grey scales whereby the capability of the display device is enhanced so as to display faithfully more colors or grey scales than it would otherwise be able to display.

SUMMARY OF THE INVENTION

This object is accomplished in accordance with the present invention by providing a display device in which every pixel is controlled so as to be illuminated only a certain number of times during a predetermined display time period. The duration of the predetermined display time period is equal to a specific number of frame time periods. The number of illuminations of a pixel during a time period is dependent on the color or the grey scale value of the pixel. More specifically, a display device in accordance with the present invention employs an improved dithering technique wherein color and/or brightness are represented not just by the spatial distribution of illuminated pixels on a displayed device, but by the number of illuminations of a pixel in a display time period. Thus, the present invention incorporates a time axis in the conventional dithering technique, thereby manipulating the average brightness of every pixel and taking advantage of the persistence of vision in order to represent faithfully color and/or brightness of an original image.

In the above-identified related application filed on even date herewith and which is incorporated herein by reference, the inventors have disclosed a first improved dithering technique which incorporates a time factor to enhance the color and grey scale capability of a display device. The present invention is directed to a second improved dithering technique which incorporates a time factor.

In accordance with the present invention, for each frame in a display period, a decision is made whether to illuminate a particular pixel by comparing its intensity value to a corresponding element of a dither matrix in accordance with equation (1) above. After each frame, however, the elements in the dither matrix are rotated or circulated into new positions according to a predetermined pattern. Thus, the dither matrix element which a particular pixel is compared to differs in each frame of the display period. In this way a time factor is incorporated into the dithering technique so that color or grey scale can be represented by the number of illuminations of a pixel over a display time period.

As a brief explanation of the inventive technique, consider the example when an original image formed from 8 grey scale values is to be displayed on a binary display device. Assume that there are 8 frame time units in each predetermined display time period, and that one frame time unit is the time needed to display the entire image on the display device, i.e., there are 8 frames in each display time period. In accordance with an illustrative embodiment of the present invention, a pixel of grey scale 1 will be illuminated for 1 frame time unit during the 8-frame display time period, while a pixel of grey scale 3 will be illuminated for 3 frame time units during the same period. Because each of the elements in a dither matrix is different, and because the elements are circulated after each frame time unit, by applying equation (1) to a pixel with a grey scale of 1, the pixel will be illuminated for exactly 1 frame time unit during the 8-frame display time period, while a pixel with a grey scale of 3 will be illuminated for 3 frame time units in the 8-frame display time period. In this manner, the full 8 grey scales can be represented on the display device over a period of time even though the display device is binary.

In addition, in order to prevent the picture from flashing, it is desirable for the frames during which the pixel will be illuminated to be distributed as evenly as possible over the 8-frame display time period. In the above example wherein a pixel is illuminated for 3 frame time units during the 8-frame display time period, if the pixel is illuminated for 3 consecutive frames, and is blackened for the following 5 frames, then the picture will flash. On the other hand, if the 3 illuminated frames are distributed evenly during this 8-frame period, the picture will appear very soft and smooth and there will be no flashing. According to the present invention, the sequence of frames during which a pixel is illuminated will be randomized by the circulation of the dither matrix elements to new positions, thereby achieving a degree of smoothness. Consequently, a display device having relatively few colors and grey scales is able to represent an original image having many more colors and grey scales.

BRIEF DESCRIPTION OF THE DRAWINGS

FIGS. 1*a*, 1*b*, 1*c* and 1*d* illustrate the implementation of a conventional dithering technique.

FIGS. 2A1–2A2 illustrates a matrix register circuit for use in the circuit of FIG. 2.

FIGS. 3(*a*)–3(*p*) illustrate the contents of a dither matrix register after each frame in a 16-frame display time period.

FIGS. 4(*a*)–4(*p*) illustrate the implementation of the present inventive technique to an original image.

DETAILED DESCRIPTION OF THE INVENTION

Figure 2:
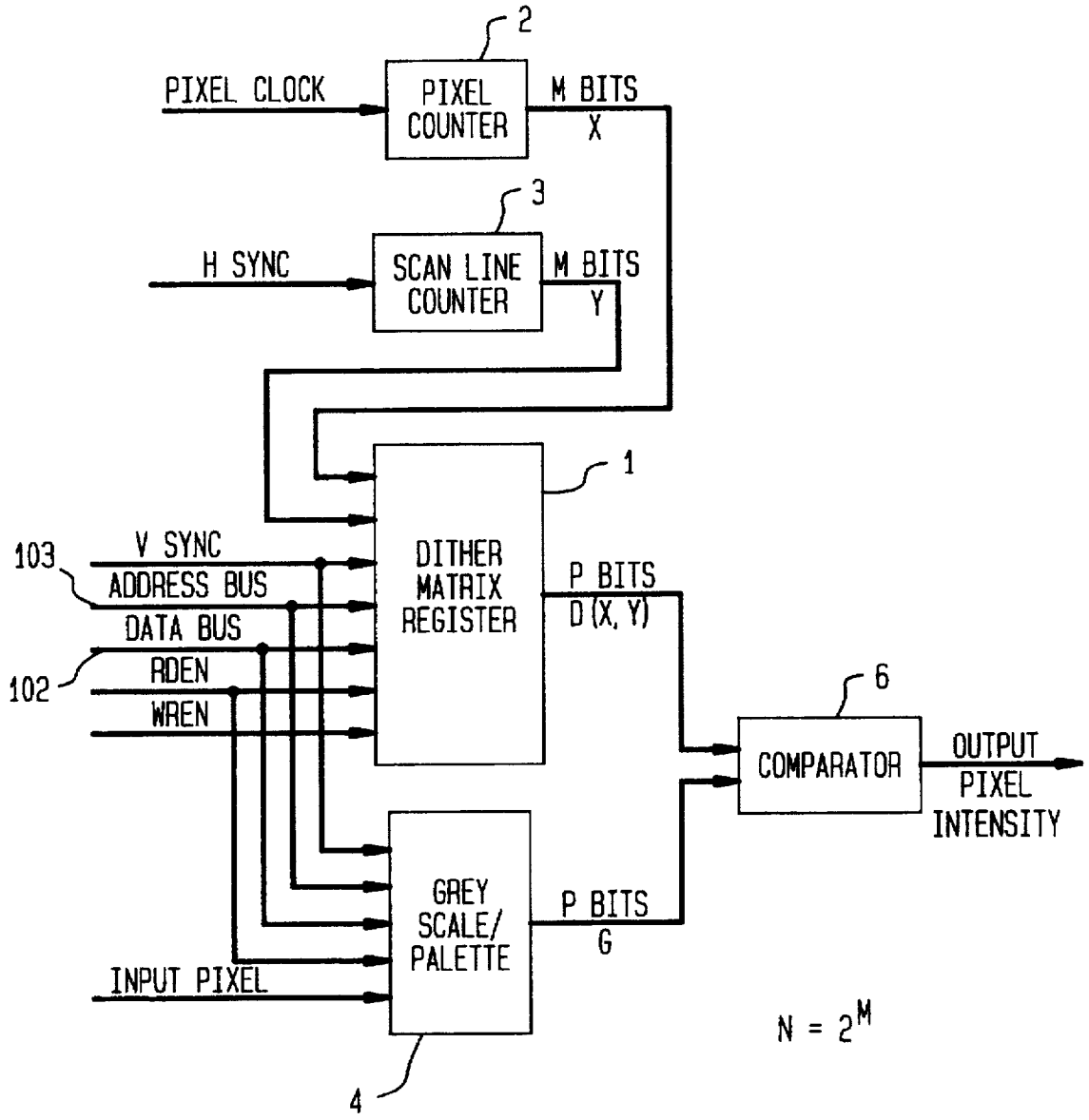
FIG. 2 is a block diagram of a circuit for implementing a dithering technique in accordance with an illustrative embodiment of the present invention.

FIG. 2 is a block diagram of a circuit in accordance with a preferred embodiment of the present invention. The circuit includes pixel counter 2 which receives a pixel clock signal and keeps track of the X-coordinate of the current pixel of the display, and scan line counter 3 which receives a horizontal sync signal (HSYNC) and keeps track of the Y-coordinate of the current pixel. Both the X-coordinate and the Y-coordinate are represented by M-bit numbers. The circuit also includes a rotatable dither matrix register circuit 1. The dither matrix is N*N, where $N=2^M$, and the rotatable dither matrix register circuit 1 stores the values of the elements of the dither matrix. The X-coordinate selected by pixel counter 2 and the Y-coordinate selected by scan line counter 3 are used to access a particular dither matrix element D(X,Y).

Figure 2A:
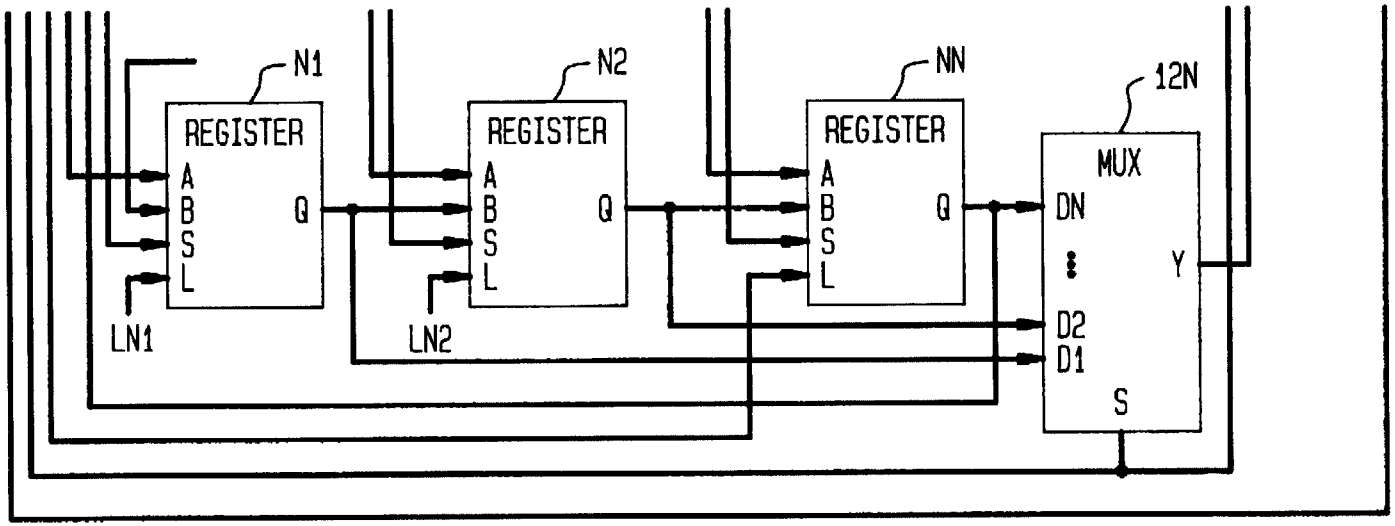

FIGS. 2A1–2A2 shows the dither matrix register circuit 1 in greater detail. The circuit comprises a plurality of registers (labeled 11, 12, . . . ,1N,21,22, . . . ,2N, . . . , N1,N2, . . . ,NN).

Figure 2B:
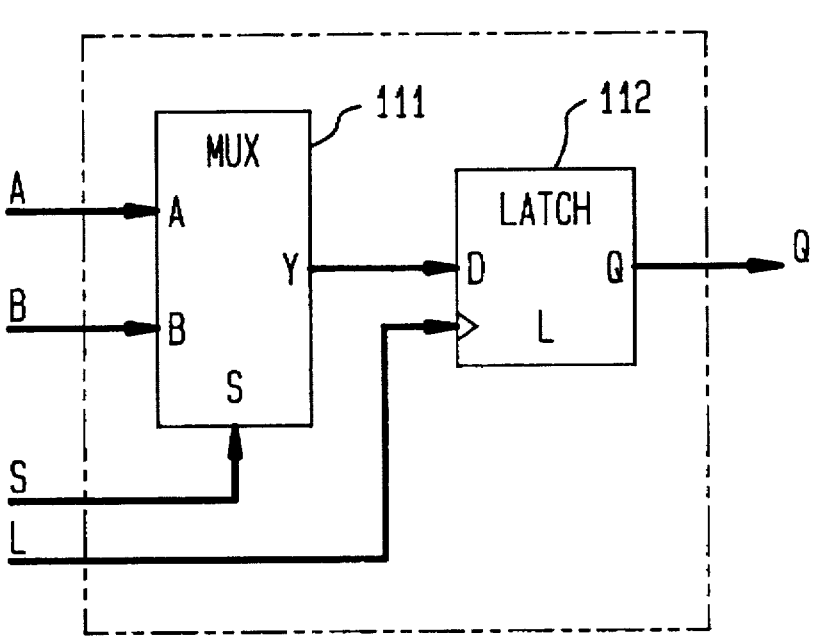
FIG. 2B illustrates a register for use in the circuit of FIGS. 2A1–2A2.

As shown in FIG. 2B, each register comprises a multiplexer 111 and a latch 112. When the select signal S is 0, the multiplexer 111 chooses the signal at the input terminal A as the output Y; when S is 1, the multiplexer 111 chooses the signal at the input terminal B as the output Y. When the latch signal L is at the rising edge, the output signal of the multiplexer 111 is to be latched in the latch 112 and is transmitted to the latch output Q. The logic table of the multiplexer 111 and latch 112 are illustrated in FIG. 2*b*.

In FIGS. 2A1–2A2, the number of registers like that of FIG. 2B is N*N. The output Q of the register 11 is connected to the input terminal B of the second register 12, and the output Q of the second register 12 is connected to the input terminal B of the third register 13. All the registers are connected in this manner, with the output of the last register NN connected to the input terminal B of the first register 11.

The dither matrix register circuit 1 of FIGS. 2A1–2A2 also comprises read/write control device 101. When the CPU does not perform a read or write operation, the CPU ENable Signal (CPUEN) will not be activated, the input terminal B of a register is selected to be the input and data is latched at the rising edge of the VSYNC signal. In other words, during the display cycle of every frame, there will be a vertical synchronous signal (VSYNC) that rotates the values in the various registers by one position, until after a display time of (N*N+1) frames the values in all these registers are restored to their original positions.

The input terminal A of each register 11, . . . ,NN is connected to a data bus 104. When the CPU performs a write operation, the CPUEN signal will be activated, the data on the data bus 104 is selected and latched in one of the registers. The values in the N*N registers are all entered in this manner. The particular register that a value on the data bus 104 should be entered into, is determined by the address on the address bus 105. That is, one of the signals L11, L12, . . . , LNN will be activated according to the address on the address bus 105. Thus, a programmer can program an appropriate selection of values into the rotatable dither matrix registers 1.

The function of the multiplexers 121,122, . . . ,12N is to select one of N inputs from the register of the corresponding row to be the output. When the CPUEN signal is not activated, the X coordinate outputted from pixel counter 2 is selected to be the select signal for multiplexers 121, 122, . . . ,12N, while the Y coordinate outputted from scan line counter 3 serves as the select signal for the multiplexer 102. In this way a particular dither matrix element can be read out of its particular register.

When the CPU performs a read operation, the CPUEN signal will be activated, a low address on the address bus will be used as the select signal for multiplexers 121, 122, . . . ,12N, and a high address will be used as the select signal for multiplexer 102. The production of these select signals are also controlled by read/write control device 101 of the dither matrix register. The control device also generates a read enable signal, RDEN, and connects it with the output enable (OE) terminal of the buffer 103. When the RDEN signal is activated, the contents of the register selected by the address bus 105 can be read out via the multiplexer 102.

Returning now to FIG. 2, the circuit illustrated in FIG. 2 also includes grey scale/color palette 4 which is optional in the circuit. For every input pixel located at the position (X,Y), an input pixel intensity value entered in the grey scale/palette 4 will output a value G that is provided to comparator 6.

Illustratively, each dither matrix element read out of the dither matrix circuit 1 has P bits. Because the pixels might flash on the display image if they are only illuminated for a few frame time units during a relatively long time period (e.g., if they are illuminated for only 1 or 2 frame time units during an 8-frame time display period), it is desirable to increase the number of grey scales and correspondingly increase the number of frame time units in the display period. For instance, if 8 grey scales are to be displayed, a better quality image can be obtained if the number of grey scales is increased to 16 and the number of frame time units in the display period is also increased to 16. This is the function of the grey scale/color palette 4. To accomplish this, an input pixel value for each input pixel is mapped into an output pixel value in the grey scale/color palette 4. In the implementation of the present invention for an original image having 8 grey scale values, the correspondence between the input grey scale values and the output G of grey scale/color palette 4 is shown in the table below. The table also shows a corresponding number of illuminated frames for a 16-frame display time period.

TABLE 1

| Grey Scale of Input Pixel | Output G of Grey Scale/ Color Palette | No. of. Illuminated Frames During 32-Frame Period |
|---|---|---|
| 0 | 0 | 0 |
| 1 | 4 | 5 |
| 2 | 6 | 7 |
| 3 | 7 | 8 |
| 4 | 9 | 10 |
| 5 | 11 | 12 |
| 6 | 13 | 14 |
| 7 | 15 | 16 |

Alternatively, the circuit shown in FIG. 2 can be constructed without grey scale/color palette 4 with the grey scale intensity value of an input pixel being provided directly to comparator 6.

In accordance with the present invention, in every frame during a display time period, the intensity of every pixel of the display device is controlled according to equation (1) above. This operation is accomplished by comparator 6 which compares the input intensity value $P_{old}(X,Y)$ (as enhanced by the optional grey scale/color palette 4 when present in the circuit) with a corresponding dither matrix element D(x,y). If the input pixel intensity value is greater than or equal to the dither matrix element, the corresponding pixel on the display device will be illuminated during that frame. On the other hand, if the input pixel intensity value is less than the dither matrix element, the corresponding pixel on the display device will not be illuminated during that frame.

Figures 3A, 3B, 4A, 4B, 5:
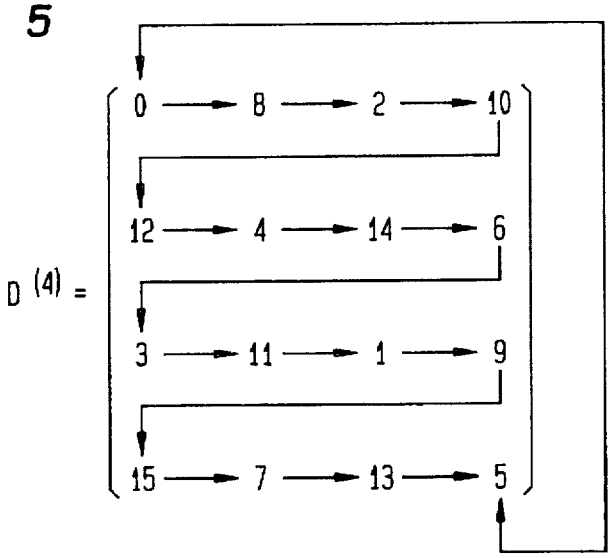
FIG. 5 illustrates a rotation pattern for the elements of a 4×4 dither matrix.

After each frame, the elements of the dither matrix are rotated or circulated so that each element occupies a different position during each frame of a full time period. For example, if a display period comprises 16 frames, then each dither matrix element will occupy 16 different positions during a full time period. One illustrative pattern of rotation for the matrix elements of a 4×4 dither matrix is shown in FIG. 5. The rotation or circulation of these matrix elements can be accomplished in the manner described above in connection with FIGS. 2A1–2A2.

FIGS. 3(*a*)–3(*p*) illustrate how the contents of the dither matrix register circuit 1 map into X-Y space after each frame in a 16-frame display time period. In FIGS. 3(*a*)–3(*p*) the frames are identified by T=0,1, . . . ,15. FIGS. 4(*a*)–4(*p*) illustrate the implementation of the present invention to a 3×3 set of pixels located at the positions shown on a display device with only one grey scale capability. For this illustration, it is assumed that each of the original image pixels has a grey scale value of 11 out of a total of 16 grey scales after processing by the palette 4. FIGS. 4(*a*)–4(*p*) show the results of comparing the original pixel intensity values to the corresponding dither matrix elements in FIGS. 3(*a*)–3(*p*) in accordance with equation (1) for each frame of the 16-frame display time period. It will be noted that each pixel having an original scale value of 11 is illuminated for exactly 12 frames during a 16-frame display time period. Thus, by controlling the number of illuminated frames in a fixed time period, and by taking advantage of the persistence of vision, an original image having 16 grey scales may be displayed with satisfactory quality on a display device having only one grey scale capability.

Although the improved dithering technique has been described up to now in relation to grey scale, it is easily adapted for enhancing the color or brightness of color capability of a color display device. For example, the circuit of FIG. 2 can be constructed with three grey scale/color palettes which will receive separate pixel input data for each of the three primary colors red, blue and green. The three grey scale/color palettes will then output separate intensity values to three comparators for separate processing according to color.

Figure 6:
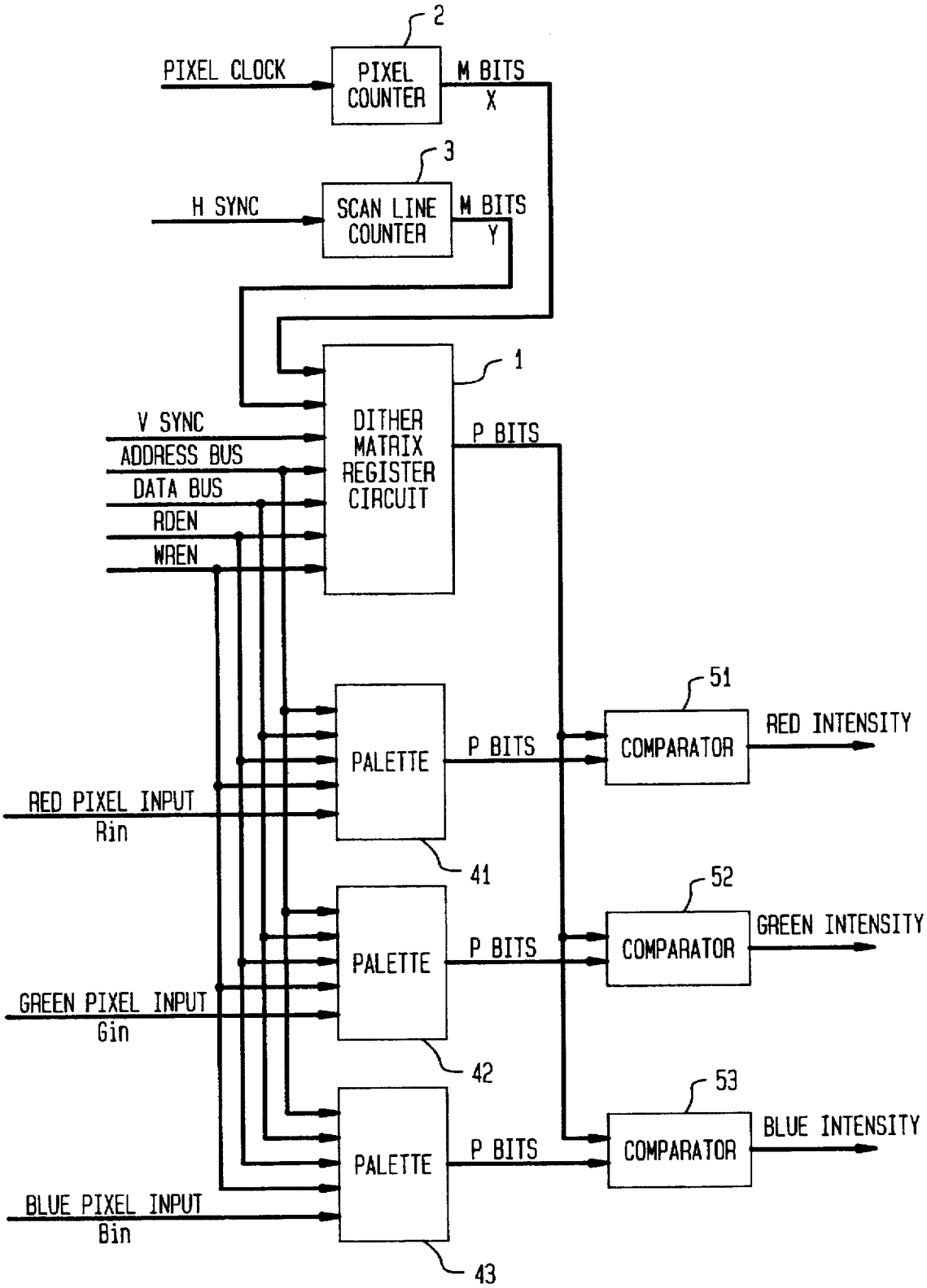
FIG. 6 illustrates a circuit which implements a dithering technique for a color image in accordance with an illustrative embodiment of the present invention.

FIG. 6 is a block diagram of a circuit according to the present invention implemented for a color display device in which each of the three colors red, green, and blue can be either on or off. It is different from FIG. 2 in that the use of the grey scale/palette 4 and comparator 5 is repeated three times (i.e., there are red, green and blue grey scale/palettes 41, 42 and 43 and red, green, and blue comparators 51, 52, 53) so as to process the three primary colors red (R), green (G) and blue (B). The red, green and blue input pixels are inputted to the palettes 41, 42, and 43, respectively. The outputs of the palettes 41, 42, and 43 are compared with dither matrix values in the comparators 51, 52, 53, and to output a red intensity (i.e. red on or off), a green intensity (i.e. green on or off) and a blue intensity (i.e. blue on or off). In this manner, it is made possible that the display device can display more colors than it would otherwise be able to do. Alternatively, the circuit can be constructed with a delay device and an additional multiplexer so that separate pixel input data for each of the colors red, blue and green can be provided at different times to a single grey scale/color palette and to a single comparator for separate processing.

To summarize, the present invention discloses an efficient apparatus and method to increase the color display capability and the grey scale display capability of a display device. The advantages can be outlined as follows:

(1) The cost of equipment can be reduced since a display device containing a small number of colors or grey scale values can now be used as a substitute for a display device that has many more colors or grey scale values but is more expensive.

(2) The invention is self-contained, expandable, and easy to implement either on a circuit board or by an ASIC.

(3) A faithful representation of the resolution, color, and brightness of an original image is achieved.

(4) The hardware architecture contains a programmable dither matrix register and a programmable grey scale/color palette so that an appropriate selection of values will result in the best possible display.

(5) The present invention is especially applicable to LCD displays. Since LCDs have been extensively used in laptop and notebook computers, the commercial value of the invention is apparent.

While the invention has been described by reference to specific embodiments, this was for purposes of illustration only. Numerous alternative embodiments will be apparent to those skilled in the art, and are considered to be within the spirit and the scope of the invention.

I claim:

1. A method for displaying pixels on a display screen comprising:

storing dither values in an array of registers representing individual locations of a dither matrix, associating said dither matrix with each of plural equal sized non-overlapping arrays of illuminate-able pixels, into which illuminate-able pixels of a display screen are divided, and associating each dither matrix location with an illuminate-able pixel of each of said arrays of illuminate-able pixels, randomizing said dither matrix by circulating each dither value stored in said array of registers from one of said registers to a different one of said registers corresponding to a new dither matrix location each frame period of a fixed interval of frame periods, each frame, generating coordinates for each pixel to be displayed on said display screen, for each pixel, retrieving from one of said registers a single dither value stored in a location of said dither matrix corresponding to said coordinates of each pixel, comparing a pixel value with said retrieved dither value in a comparator circuit, and illuminating each illuminate-able pixel during said frame if said pixel value at least equals said retrieved dither value.

2. A circuit for temporally dithering pixels comprising:

an array of registers that store a dither matrix, each register corresponding to a particular location of said dither matrix and storing a dither matrix element of said corresponding dither matrix location, said registers of said array being connected together so as to randomize said dither matrix each frame by circulating each dither matrix element stored therein from one of said registers to a different one of said registers, a plurality of illuminate-able pixels of a display screen organized into one or more non-overlapping arrays of pixels such that each illuminate-able pixel of a given one of said arrays of pixels is associated with a mutually different one of said dither matrix storage locations, circuity which during each frame of a fixed interval of frames, generates coordinates for each of said illuminate-able pixels within each array, and for each illuminate-able pixel during each frame, retrieves from one of said registers corresponding to said dither matrix location associated with said illuminate-able pixel, a single dither matrix element, compares the value of said retrieved dither matrix element with a pixel value and illuminates said illuminate-able pixel during said frame if said compared pixel value at least equals said retrieved dither matrix element.

3. The circuit of claim 2 further comprising:

a palette circuit for receiving a first input value for each of said illuminate-able pixels and for mapping said first input value to a grey scale intensity value which serves as said pixel value of said illuminate-able pixel for use by said circuitry.

4. The circuit of claim 2 wherein said circuitry is also for writing dither matrix elements into particular ones of said registers in said array.

5. The circuit of claim 2 wherein said display screen is a black and white display device and said pixel value is a grey scale.

6. The circuit of claim 2 wherein said display screen is a color displayed device and said input pixel value includes separate input pixel values for each of the colors, red, green and blue.

7. The circuit of claim 2 wherein said circuitry includes plural circuits, including one for each of the colors, red, green and blue, operative during each frame of said interval of frames for determining an output pixel value.

8. A circuit for temporally dithering pixels comprising:

an array of registers that store a dither matrix, each register corresponding to a particular location of said dither matrix and storing a dither matrix element of said corresponding dither matrix location, said registers of said array being connected together so as to randomize said dither matrix each frame by circulating each dither matrix element stored therein from one of said registers to a different one of said registers wherein at least one of said registers comprises a multiplexer and a latch connected to the multiplexer, said multiplexer selectively connecting to an input of said latch, one of a dither matrix element from another register connected upstream of the particular register and data from a data bus, a plurality of illuminate-able pixels of a display screen organized into one or more non-overlapping arrays of pixels such that each illuminate-able pixel of a given one of said arrays of pixels is associated with a mutually different one of said dither matrix storage locations, circuity which during each frame of a fixed interval of frames, generates coordinates for each of said illuminate-able pixels within each array, and for each illuminate-able pixel during each frame, retrieves from one of said registers corresponding to said dither matrix location associated with said illuminate-able pixel, a single dither matrix element, and illuminates said illuminate-able pixel during said frame depending on a pixel value to which said illuminate-able pixel is to be illuminated and said single dither matrix element retrieved during said frame.

9. A circuit for temporally dithering pixels comprising:

an array of registers that store a dither matrix, said array of registers including only one register for each one of a plurality of dither matrix elements, each register corresponding to a particular location of said dither matrix and storing said one of said plurality of dither matrix elements, said registers of said array being connected together so as to randomize said dither matrix each frame by circulating each dither matrix element stored therein from one of said registers to a different one of said registers so that each dither value circulates to a register formerly occupied by a dither value corresponding to a different one of said intensity levels, a plurality of illuminate-able pixels of said display screen organized into one or more non-overlapping arrays of pixels such that each illuminate-able pixel of a given one of said arrays of pixels is associated with a mutually different one of said dither matrix storage locations, circuity which during each frame of a fixed interval of frames, generates coordinates for each of said illuminate-able pixels within each array, and for each illuminate-able pixel during each frame, retrieves from one of said registers corresponding to said dither matrix location associated with said illuminate-able pixel, a single dither matrix element, compares a pixel value to which said illuminate-able pixel is to be illuminated with said single retrieved dither matrix element, and illuminates said illuminate-able pixel during said frame if said pixel value at least equals said single dither matrix element retrieved during said frame.

* * * * *